US005523930A

United States Patent [19]

Fritts

[11] Patent Number: 5,523,930

[45] Date of Patent: Jun. 4, 1996

[54] FLUORESCENT BACKLIT DISPLAYS OR THE LIKE

[76] Inventor: Robert W. Fritts, 1575 N. Second St., Stillwater, Minn. 55082

[21] Appl. No.: 60,261

[22] Filed: May 12, 1993

Related U.S. Application Data

[63] Continuation-in-part of Ser. No. 895,276, Jun. 8, 1992, Pat. No. 5,282,117, which is a continuation-in-part of Ser. No. 763,624, Sep. 23, 1991, abandoned, which is a continuation-in-part of Ser. No. 573,475, Aug. 24, 1990, abandoned.

[51] Int. Cl.[6] ..... G09F 13/14

[52] U.S. Cl. ..... 362/223; 362/307; 362/311; 362/328; 362/330; 362/260; 362/238; 40/564; 40/605

[58] Field of Search ..... 362/222, 223, 362/224, 307, 308, 309, 311, 326, 327, 328, 330, 332, 339, 97, 249, 260, 256, 216, 343, 267, 351, 240, 238; 40/564, 605

[56] References Cited

U.S. PATENT DOCUMENTS

| | | | |
|---|---|---|---|
| 2,320,815 | 6/1943 | Cushing | 362/223 |
| 3,768,186 | 10/1973 | Chase et al. | 40/564 |
| 4,074,452 | 2/1978 | Bellinder | 40/573 |
| 4,335,421 | 6/1982 | Modia et al. | 362/346 |
| 4,388,675 | 6/1983 | Lewin | 362/260 |
| 4,418,378 | 11/1983 | Johnson | 362/343 |
| 4,729,075 | 3/1988 | Brass | 362/223 |
| 4,751,434 | 1/1988 | Helling et al. | 362/216 |
| 5,020,252 | 6/1991 | DeBoef | 40/564 |
| 5,038,259 | 8/1991 | Katoh et al. | 362/256 |
| 5,134,553 | 7/1992 | Hasegawa | 362/223 |
| 5,186,537 | 2/1993 | Katoh et al. | 362/223 |
| 5,192,129 | 3/1993 | Figueroa | 362/260 |
| 5,207,495 | 5/1993 | Ahlstone | 362/97 |

*Primary Examiner*—Denise L. Gromada
*Assistant Examiner*—Leonard Heyman
*Attorney, Agent, or Firm*—Joseph C. Schwalbach

[57] ABSTRACT

A fluorescent backlit display or the like embodying a generally planar light transmissive display panel, a back wall having a generally planar diffusely reflective surface facing, spaced from and parallel with the display panel an array of spaced parallel cylindrical lamps between and parallel with the display panel and back wall, improved light leveling means including masking means on the side of each lamp facing the display panel, and a light spreader associated with each lamp at the diffusely reflective back wall surface and effective to reflect laterally outwardly onto the back wall surface light flux directed thereat from the side of said lamps facing said back wall, whereupon the thus reflected light flux is directed forwardly toward areas of said display panel in front of the respective lamps. The display is of modular construction and employs a rectangular supporting frame on the front of which the display panel is mounted and in which modular lighting units are readily removably accommodated in operative position in side by side abutting relation. Each lighting unit has at least one lamp carried by a tray in a manner to dispose all of the lamps in equally spaced parallel relation when the lighting units are in operative position. Lighting unit trays are optionally sectional to facilitate handling and shipping.

23 Claims, 12 Drawing Sheets

FOOT-LAMBERTS
370
360
350
340
330
320
104
105
106
107
6" 5" 4" 3" 2" 1"
1" 2" 3" 4" 5" 6" 7"

Fig. 13
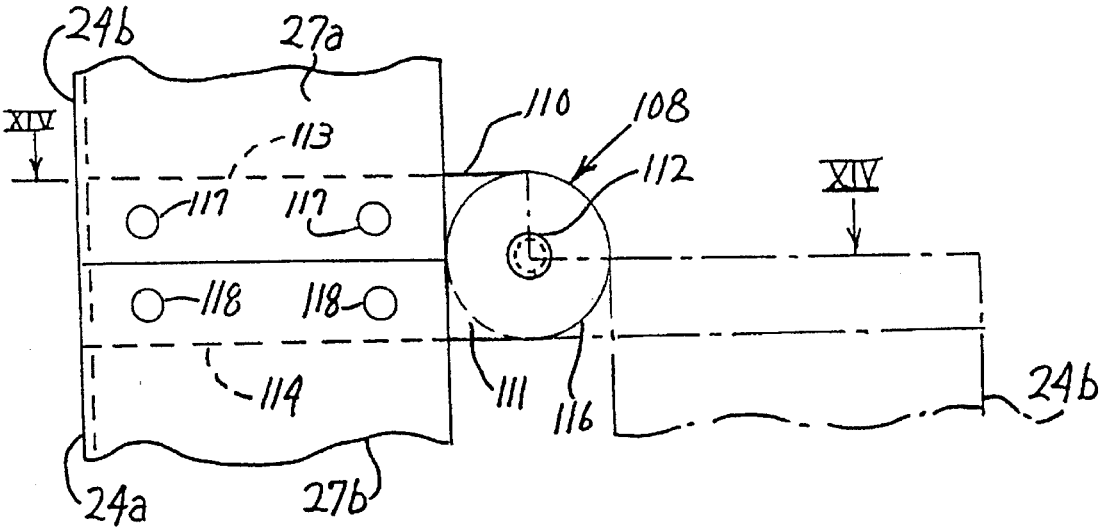
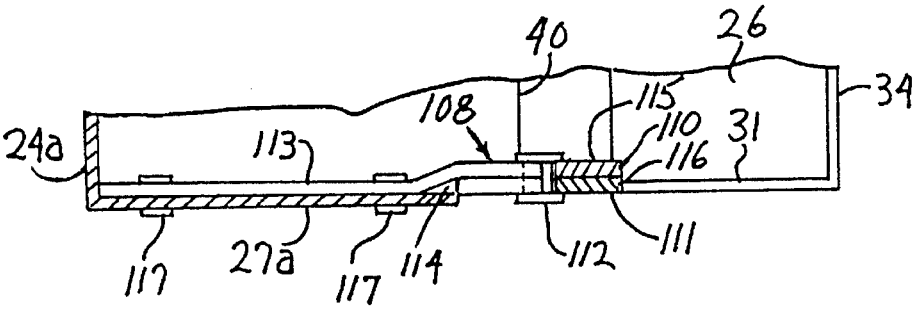
Fig. 14

FLUORESCENT BACKLIT DISPLAYS OR THE LIKE

CROSS REFERENCE

This application is a continuation-in-part of U.S. application Ser. No. 07/895,276, filed Jun. 8, 1992, now U.S. Pat. No. 5,282,117, which is a continuation-in-part of abandoned application Ser. No. 07/763,624, filed Sep. 23, 1991, now abandoned, which is a continuation-in-part of abandoned application Ser. No. 07/573,475, filed Aug. 24, 1990, now abandoned.

BACKGROUND OF THE INVENTION

1. Field of the Invention

This invention relates in general to backlit displays, and more particularly to the illumination of a generally planar light transmissive image by light from a plurality of elongated tubular lamps in spaced parallel relation to each other and to said image. The displays of the invention incorporate modular sectional components and provide illumination of an image which is free of light patterns or shadows discernable to the human eye.

2. Description of the Prior Art

Large backlit displays currently used for illumination of translucent display panels bearing, for example, photographic scenes for indoor viewing in environments such as museums, airports, tradeshows and the like, suffer from a number of problems.

Current practice in such displays has been to use therein an array of equally spaced fluorescent lamps whose axes are parallel and are spaced from the plane of a translucent image bearing panel a distance generally equal to the distance between the lamp axes. This has lead to the use of displays having light box depths of about 10 to 12 inches. Such installations are massive in appearance, and are costly to manufacture, ship and install. Moreover, the currently available backlit displays supplied for the environments mentioned, provide inadequate illumination uniformity, the inferior quality of which is perceivable to the human eye, under certain conditions, as light patterns or shadows.

In my research aimed at producing ultimate perfection in uniform illumination of backlit displays, I found that the eye seems to see brightness nonuniformities to varying degrees depending upon the size of the image, the tonal density of the image, and the percentage of constant tonal density within a given image.

Prior art patents of which I am aware, which have addressed the problem of uniformity of backlit type illumination, have dealt with devices using one or two lamps in small backlit displays. One such patent states that a 10% range of variation in brightness is not detectable by the human eye. My experience, working with larger multi lamp displays, shows that a 10% brightness variation is objectionably visible in all types of large photographic scenes. The reason for this is apparently a psychological one, perhaps because large multi lamp displays show an extended repeat pattern of density variations which the eye can detect more readily than the one or two bright regions found in the one or two lamp small displays of the prior art.

In my copending U.S. Pat. No. 5,282,117. I disclosed various embodiments of a variable opacity masking system for use in a backlit display to block a first percentage of the light flux that is directed from a lamp therein along a plane which includes the lamp axis and the longitudinal axis of the mask and is normal to the display image panel. That masking system substantially reduces the intensity of the light at the portion of the image surface closest to the lamp, i.e., in the aforementioned plane. A maximum of light is blocked by the opacity of the mask at said plane, and the opacity of the mask is symmetrically reduced at increasing lateral distances on each side of its longitudinal axis, reaching zero at the margins of the mask.

The masking system of my earlier application aforementioned produced excellent results in light boxes of 5 inch depth in which the lamps were spaced apart 10 inches. Masks in planar form were positioned anywhere between the surface of the lamp and a distance of about 2 inches in front of the lamp axis, the space between the margins of the mask increasing with the distance of the mask from the lamp axis. Thus, the mask was wider at the 2 inch distance and narrower at the point of tangency with the lamp surface. Since the masks in planar configuration required separate planar light transmissive supporting means, a semicylindrical mask wrapped around and attached directly to the surface of the lamp became the preferred embodiment, because it involved fewer parts and lower manufacturing cost.

Both the planar and the semicylindrical shaped masks accomplished significant reductions in the bright pattern of lamps superimposed onto the image panel of prior backlit displays. For example, in the light box geometry mentioned above, the lamps created a brightness differential of about 15 percent when no masking was used. However, the same lamps, when provided with the masking means of my prior application, exhibited a dramatically reduced brightness differential of less than 3 percent. This represents a five-fold reduction in brightness differential and a substantial improvement over the 10 percent brightness differential stated as acceptable in the prior art.

SUMMARY OF THE INVENTION

A study of various large format backlit photographic images, involving measurement of illumination densities using high precision spot photometry, revealed that the most difficult part of an image to illuminate uniformly is a portion of a scene having intermediate tonal density, i.e., neither fully transmissive nor fully opaque, but in between, which occupies a large percentage of the viewed scene. An example of this is a sunset scene in which a large part of the image is a darkened cloudless sky where the mid tone sky extends across the full width of the image.

In this study it was noted that, when the preferred cylindrical masks were used to level the brightness differential of illumination of large format photographic images of the kind represented by the aforementioned sunset scene, residual shadows remained visible to the human eye, even though a maximum brightness nonuniformity of 2.3 or 2.5 percent was achieved. Such shadows occurred in the intermediate tonal areas of the photographic scene directly in front of the illuminating lamps. Upon observing this unique circumstance, it was determined that, while a brightness differential of 3 percent may provide a quality of illumination which can be considered good when applied to many types of images, there is clearly a need for a backlit display providing a quality of brightness uniformity which would be considered excellent for all images.

Accordingly, it is a principal object of the present invention to provide an improved backlit display which is capable of illuminating images with a maximum brightness variation of about 1 percent while employing the preferred semicylindrical masks. In my experience, such a variance is not discernible to the human eye in the intermediate tonal areas of any photographic scene.

Another principal object of the invention is to provide an improved backlit display construction which can be expeditiously installed with the expenditure of a minimum amount of labor by virtue of incorporation therein of modular components which eliminate the need for heavy lifting or on-site construction.

Another more specific object of the invention is to provide an improved backlit display in which the elongated cylindrical lamps employed are incorporated into modular lighting units, each of which removably carries a pair of spaced parallel lamps mounted on an elongated rectangular tray which is preferably formed in sections to facilitate packing and shipping.

Another object of the invention is to provide a backlit display of the type described in which a plurality of the modular lighting units is removably mounted in side by side relation in a rectangular frame which can be mounted on a supporting wall or can be provided with its own free standing support structure, the width of the frame, and hence the number of modular lighting units mounted therein, being determined by the width of the image to be illuminated by the display.

A more specific object of the invention is to provide, in a backlit display of the class described, light spreading means associated with each lamp therein and effective to reflect light flux projected thereonto from the back of said lamp laterally outwardly toward locations on the diffusely reflective back wall of the display from which said light flux, upon contact with the back wall, is reflected forwardly toward portions of the display panel in front of the said lamp along paths disposed laterally outwardly from the respective lamps, i.e., through the spaces between adjacent lamps.

Other and further objects and advantages of the invention will appear to those skilled in the art as the description proceeds, reference being had to the accompanying drawings.

BRIEF DESCRIPTION OF THE DRAWINGS

In the drawings accompanying and forming a part of this application,

FIG. 13 is a fragmentary side elevational view of the hinge portion of a lighting unit tray of sectional form as viewed along line XIII—XIII of FIG. 4; and FIG. 14 is a horizontal sectional view taken along the stepped line XIV—XIV of FIG. 13.

DESCRIPTION OF THE PREFERRED EMBODIMENT

Figure 8:
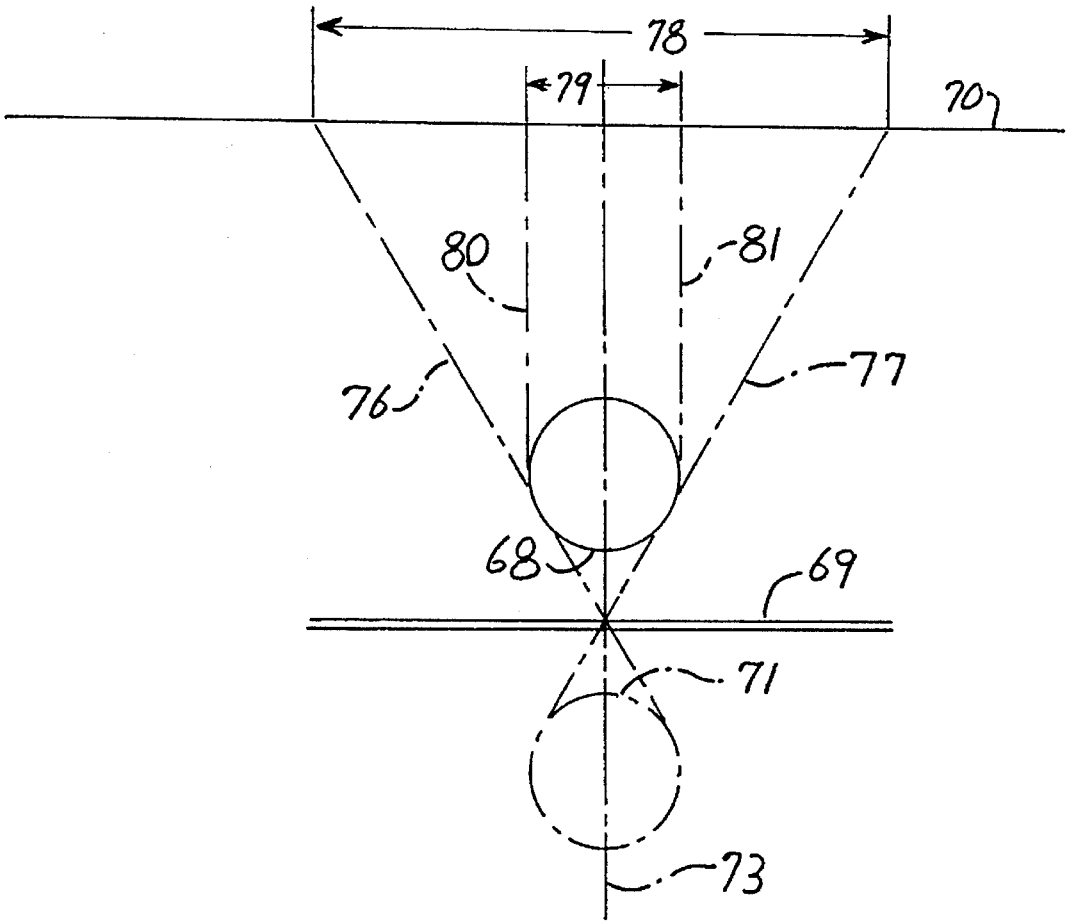
FIG. 8 is a diagram on a horizontal plane through a display panel, a lamp and a backwall of a backlit display, which illustrates how the lamp blocks light flux reflected forwardly from the backwall toward the display panel.

The operation of the invention can perhaps best be understood after a preliminary discussion of the operation of conventional backlit displays. FIG. 8 of the drawings illustrates diagrammatically in solid line a transverse section of a cylindrical lamp 68 whose axis is in parallelism between a planar back wall 69 having a diffusely reflective surface, and a planar translucent display panel 70. In this set up, the lamp 68 actually performs as a doublet pair of lamps when serving as a light flux source for the portion of an image on the display panel 70 in front of said lamp. Lamp 68 projects light flux radially, and the portion thereof directed rearwardly toward the back wall is diffusely reflected forwardly as though it were originating from a "virtual" lamp 71, illustrated in phantom lines. The virtual lamp 71 is spaced behind the reflective surface of the back wall 69 a distance equal to the distance that the lamp 68 is spaced in front of said wall surface. The intensity of the light projected from the virtual lamp 71 is approximately 80 percent of that directed rearwardly from the lamp 68, 80 percent reflectivity being the approximate reflectivity of diffusely reflective white paint.

Figure 9:
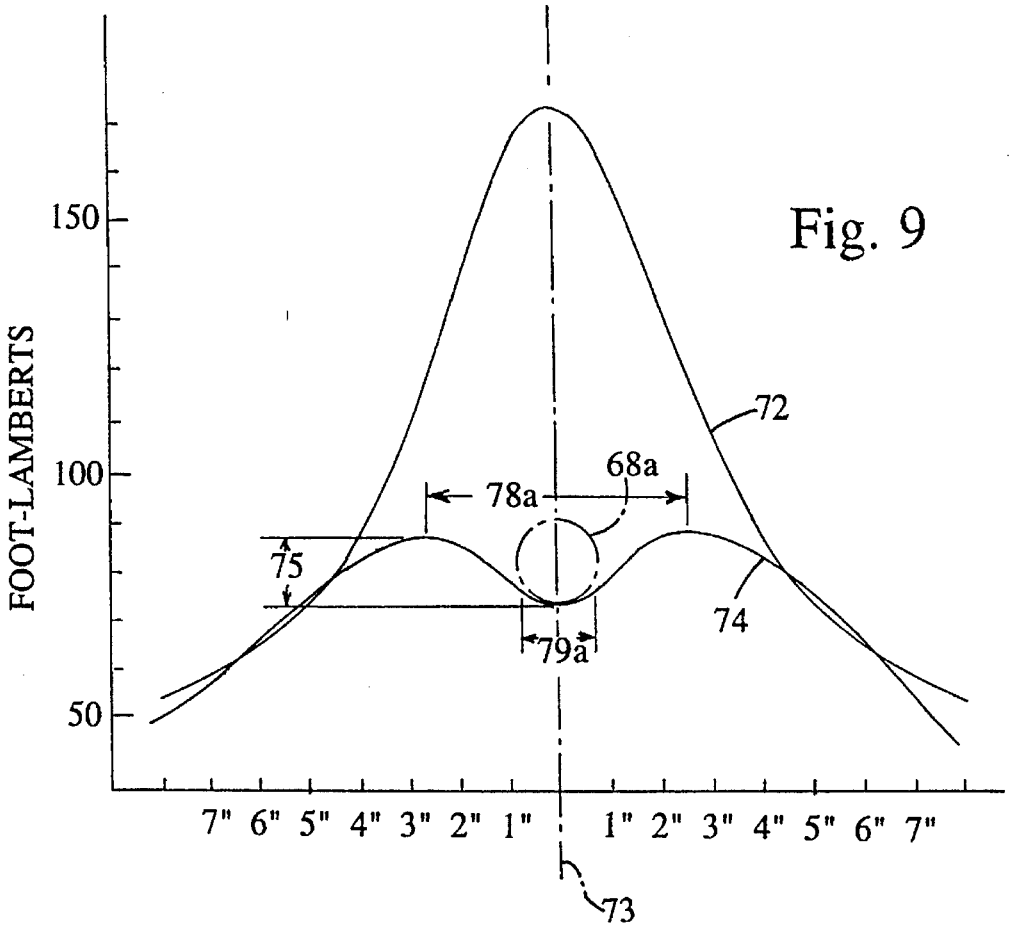
FIG. 9 shows curves representing photometric scans of a display panel in front of one lamp of several in parallel, respectively illustrating the illumination of the display panel resulting from exposure to light flux from the front half of the lamp only, and the by light flux from the rear half of the lamp only.

The phantom lines 76 and 77 in FIG. 8 define an area 78 on the display panel 70 in which, as will become apparent hereinafter, light from the virtual lamp 71 is blocked to varying degrees by the lamp 68. Parallel phantom lines 80 and 81 define an area 79 on the display panel 70 directly in front of the lamp 68. In FIGS. 8 and 9 the phantom line 73 indicates the plane which includes the axis of lamp 68 and which is normal to the display panel 70.

By careful experimentation with a backlit display having a back wall, lamp and display panel arranged as shown in FIG. 8, the frontal contribution of the lamp 68 to the display panel brightness was measured across the display panel 70 in front of said lamp. The contribution to the display panel brightness made by the light directed rearwardly from the lamp 68 and reflected forwardly by the back wall 69 towards said display panel 70 was also measured. During the measurement of the frontal contribution of the lamp 68, the back semicylindrical surface of said lamp was covered with black, light absorptive plastic tape, and when the contribution from the rear of the lamp 68 was measured, the front semicylindrical surface of said lamp was covered by black, light absorptive plastic tape.

FIG. 9 illustrates the respective contributions to the brightness of the display panel 70 of FIG. 8 made by light flux emitted from the front and rear surfaces of the lamp 68. Light measurements were taken with a high sensitivity photometer along the surface of the display panel 70, in a direction normal to the axis of the lamp 68, and the curve 72 represents the measured brightness in foot lamberts generated by light flux projected from the front of the lamp. The curve 74 in FIG. 9 represents the amount of light flux reaching the display panel 70 from the rear half of the lamp 68, the light measurements therefor having been taken at the same points along the display panel 70 as those which were productive of curve 72.

It will be observed that the curve 74 exhibits a dip 75 in the central portion thereof, the minimum value of which, at the plane 73, is about 14 foot lamberts less than the maximum values on each side of said dip. In FIG. 9, the portion 78*a* of curve 74 corresponds to the dimension 78 on display panel 70 in FIG. 8. The portion 79*a* of curve 74 directly below the lamp 68*a*, which is shown in phantom line, corresponds to the area 79 on the display panel in FIG. 8. The area 79 in FIG. 8 represents the densest portion of the shadow cast toward the image plane 70 by the lamp 68. On each side of the area 79 on display panel 70, the density of the shadow is attenuated until it disappears substantially completely at the margins of the space 78 thereon. The data from which the curves 72 and 74 in FIG. 9 were generated, were produced by the use of a T12 (1.5 inch diameter) fluorescent lamp. Almost identical results (not shown) are obtained with T8 (1.0 inch diameter) fluorescent lamps.

The unexpected result from the measurements described is that the dip 75 in curve 74 occurred in the same plane 73 that the curve 72 peaks. This confirms that the lamp 68 is casting a shadow in the light flux coming forward from the virtual lamp 71 in FIG. 8, the total light flux falling upon the display panel 70 being the sum of these two components, as confirmed by direct measurement. The shadowing effect of lamp 68 is significant when the preferred semicylindrical masking elements are mounted on the front face of the lamp, i.e., the side facing the display panel.

Figure 1:
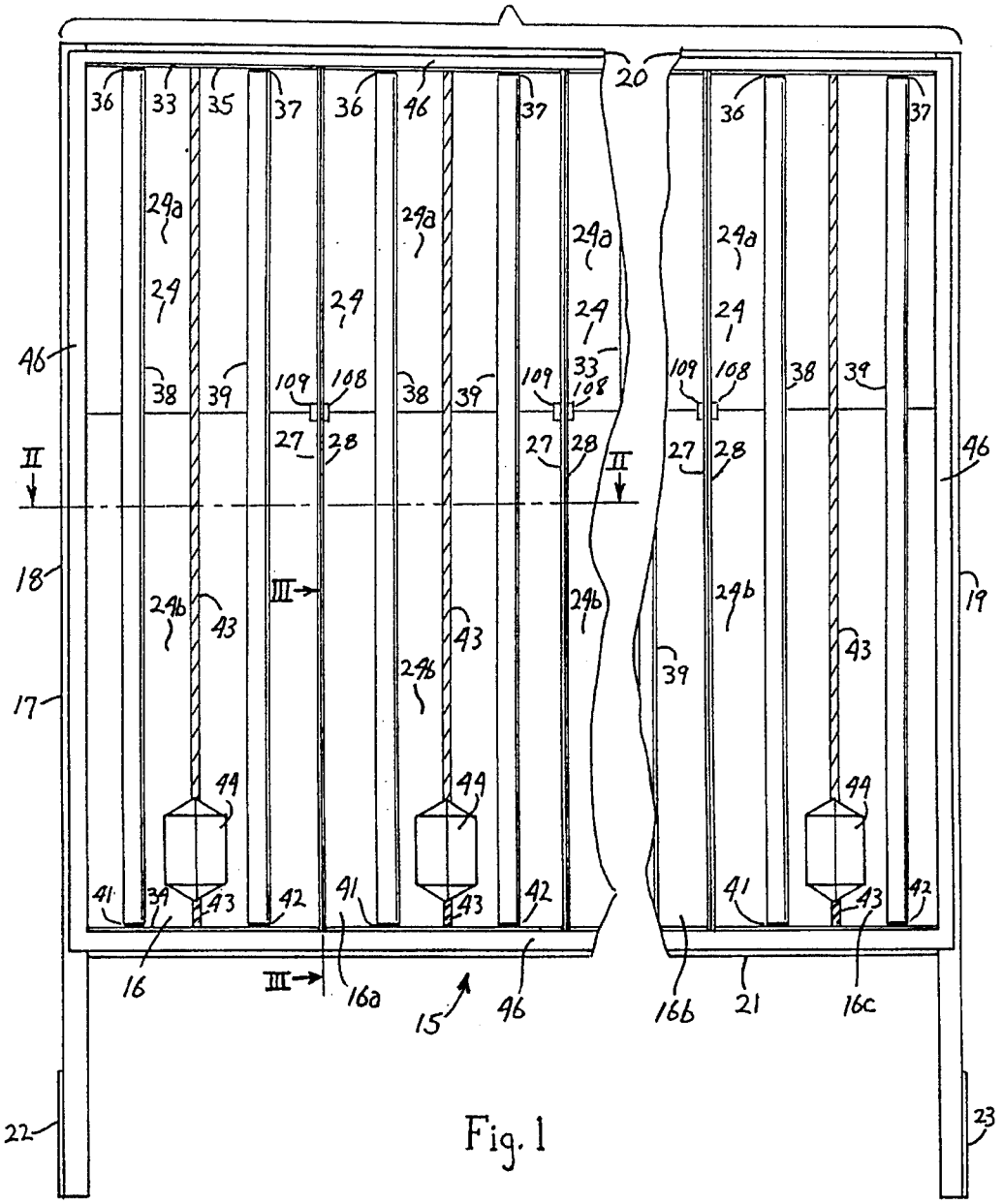
FIG. 1 is a fragmentary front elevational view of one form of backlit display constructed in accordance with the invention, the cylindrical masks for the lamps, as well as the display panel having been removed.
Figure 2:
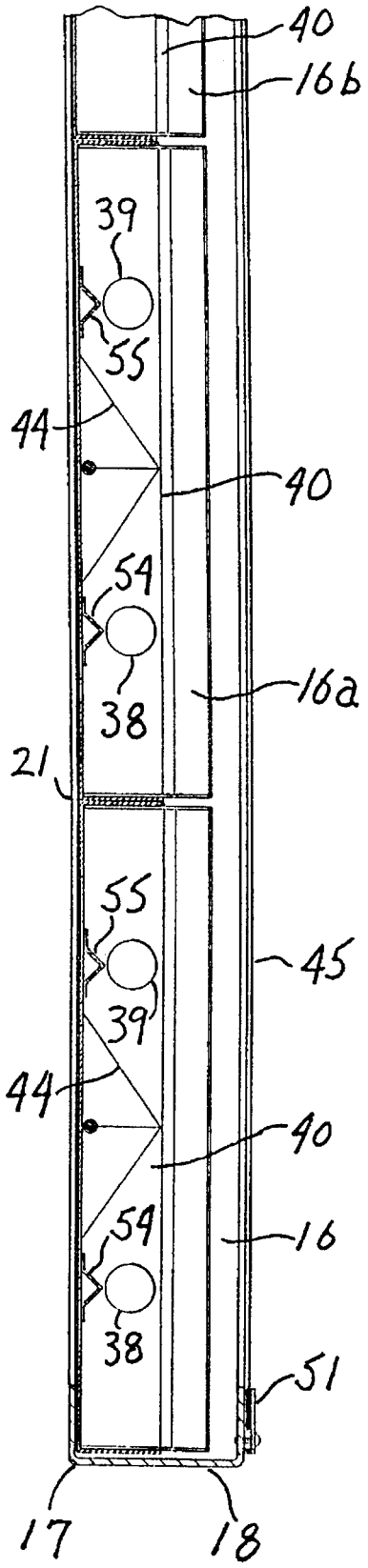
FIG. 2 is a fragmentary horizontal sectional view taken along the line II—II of FIG. 1.

Referring now to FIG. 1 of the drawing, the numeral 15 indicates a free standing fluorescent backlit display constructed in accordance with the present invention and which has the display panel thereof removed to expose the modular lighting units 16, 16*a*, 16*b* and 16*c*. The display 15 comprises a rectangular supporting frame 17 having spaced parallel vertical channels 18 and 19 and upper and lower horizontal channels 20 and 21. It will be observed that in the illustrated embodiment the vertical frame channels 18 and 19 extend below the horizontal lower frame channel 21 and are provided respectively with suitable horizontally extending base members 22 and 23. The modular lighting units 16 to 16*c* are enclosed within the channels of the frame 15 and are in side-by-side abutting relationship as best shown in FIG. 2.

Figure 4:
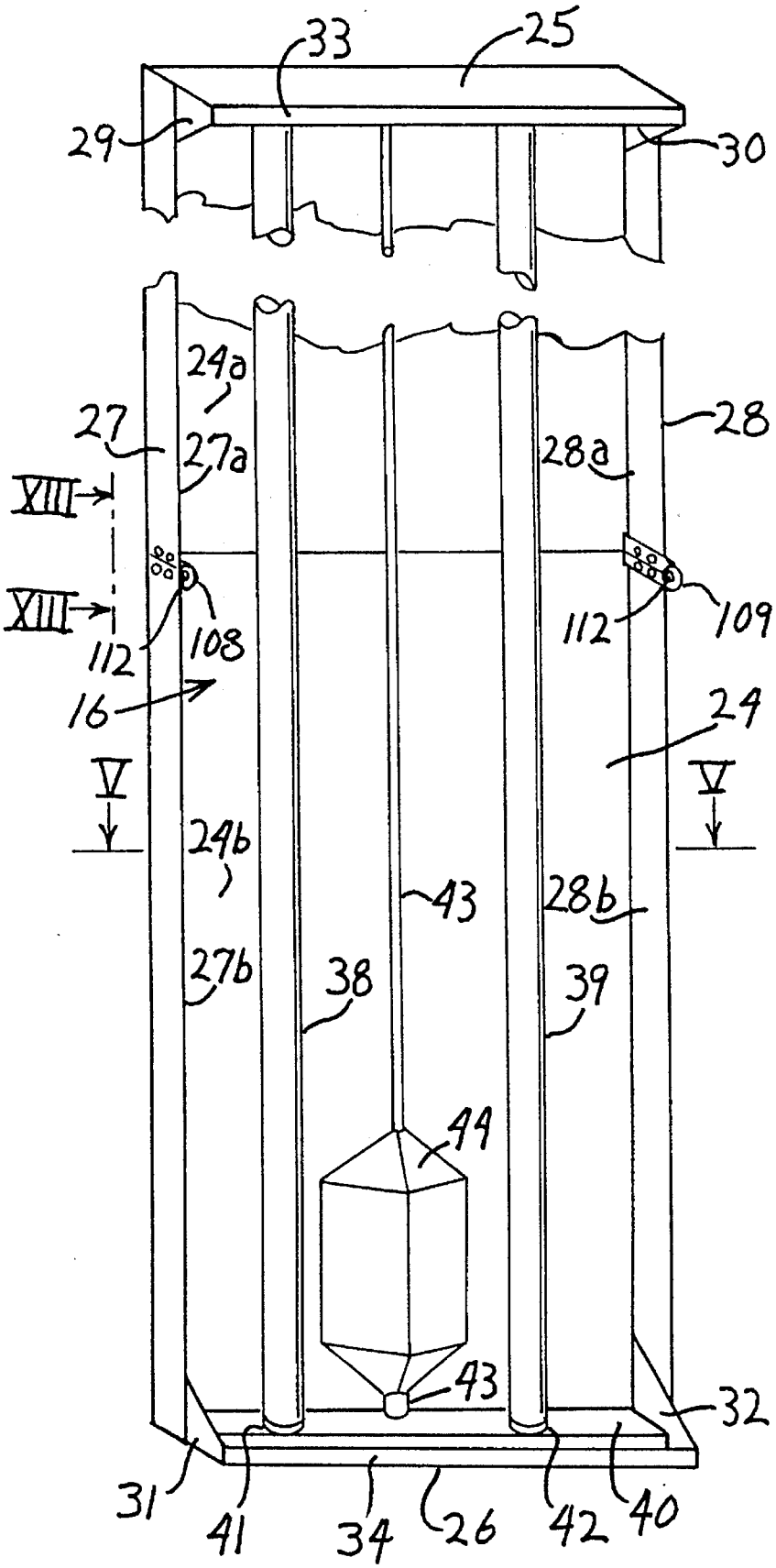
FIG. 4 is a fragmentary front perspective view of one of the modular lighting units of the invention shown in FIG. 1.

All of the modular lighting units are preferably identical, and the unit 16 is shown in an elevational perspective view in FIG. 4. In FIG. 4 the unit 16 is shown as comprising an elongated rectangular tray 24 formed of upper and lower sections 24*a* and 24*b*, respectively. The tray 24 has an upper end shelf 25 and a lower end shelf 26, both projecting generally normal to the plane of said tray. Short longitudinal side walls 27 and 28 formed in sections 27*a* and 27*b* and 28*a* and 28*b* extend longitudinally of the tray 24 and normal thereto at the side margins thereof. The upper and lower shelves 25 and 26 have tapered sidewalls 29 and 30 and 31 and 32, respectively. The upper shelf 25 has a down turned flange 33 at its outer edge, and the lower shelf 26 has an upturned flange 34 at its outer edge, said flanges being suitably joined at their ends to the outer ends of the aforementioned shelf sidewalls. The shelf side walls 29 and 31 are suitably secured to the ends of longitudinal side wall 27, and the shelf side walls 30 and 32 are suitably secured to the ends of longitudinal side wall 28 of tray 24.

Figure 3:
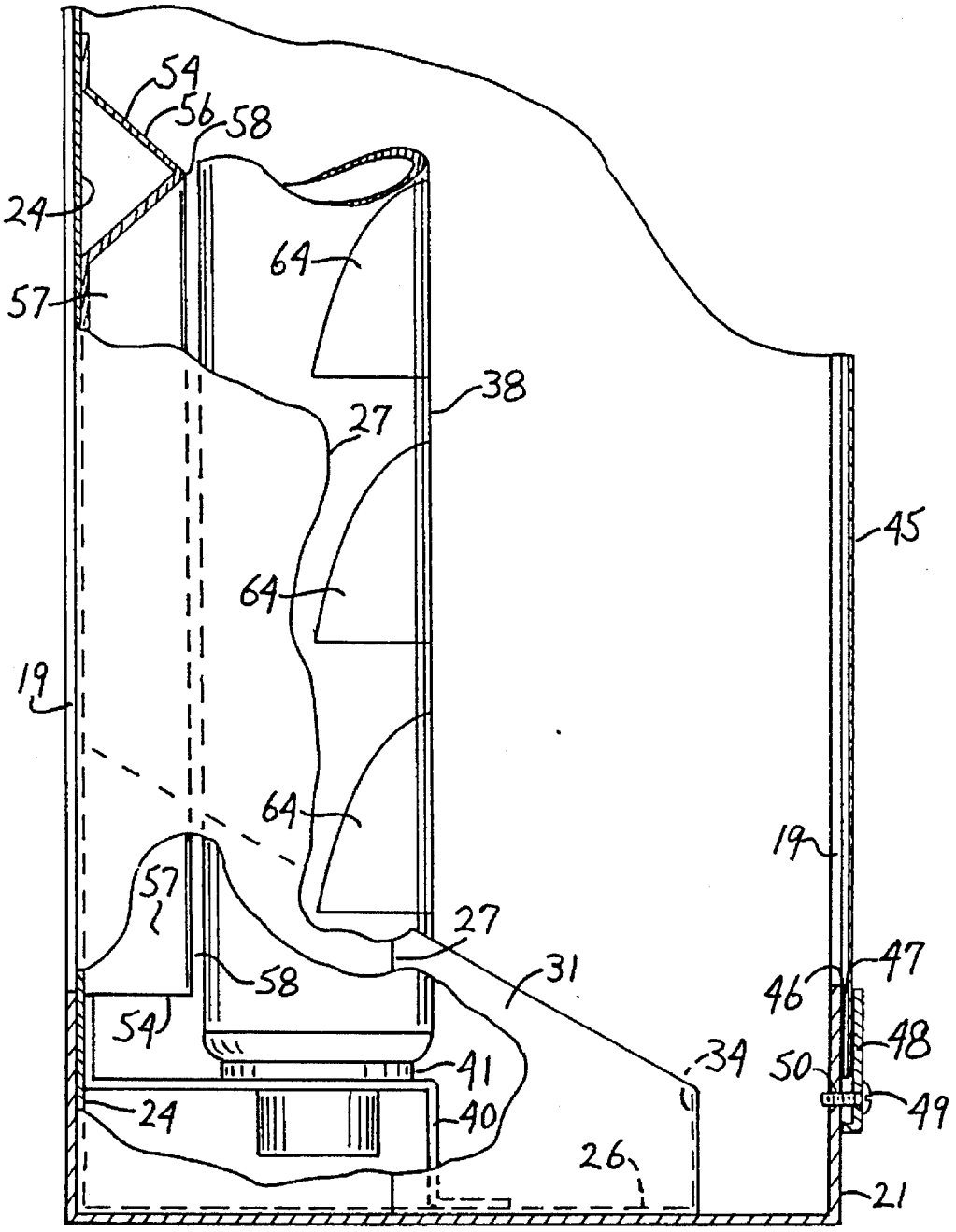
FIG. 3 is a partial vertical sectional view taken along the line III—III of FIG. 1 and showing a modular lighting unit in partial side elevation, parts being broken away.
Figure 5:
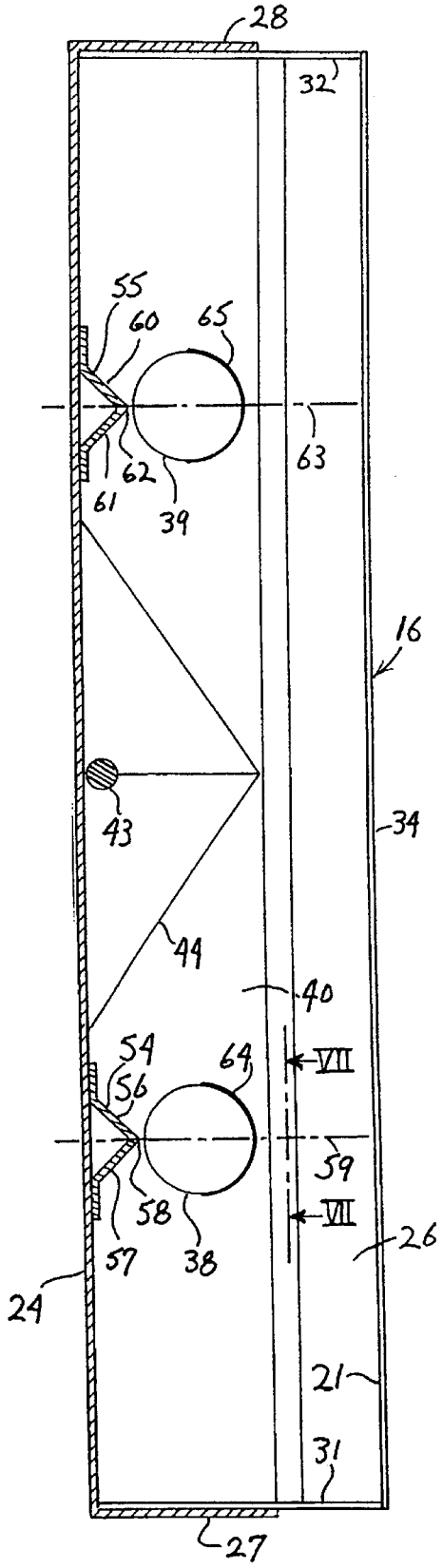
FIG. 5 is a horizontal sectional view on a somewhat enlarged scale taken along the line V—V of FIG. 4.

As shown in FIGS. 3, 4 and 5, there is mounted on the lower shelf 26 a fixture 40 having a pair of spaced receptacles 41 and 42 for the lower end of a pair of elongated cylindrical fluorescent lamps, such as the T12 lamps 38 and 39 which are 1.5 inches in diameter. A similar fixture (not shown) is mounted on the underside of upper shelf 25 and is provided with receptacles (not shown) for the upper ends of the lamps 38 and 39. The lamps 38 and 39 are preferably parallel and have their axes spaced apart about 10 inches. Said lamps are also parallel with the tray 24 and preferably have their axes spaced therefrom a distance of 1.5 inches.

The width of the tray 24 is not critical, but for convenience of handling, it preferably has a width of about 20 inches. The lamps 38 and 39 are arranged so that the axis of each lamp is spaced from the adjacent side wall of the related tray a distance of about 5 inches. This arrangement is such that when a number of like lighting units are disposed within the frame 17 in side by side abutting relation, the axes of all of the lamps in the array thus formed are equally spaced about 10 inches apart. A ballast (not shown) is provided with each lighting unit and is electrically connected to the receptacles in fixture 40, and to those in the fixture (not shown) carried by the shelf 25, by a suitable flexible conduit 43. The ballast (not shown) is enclosed within a ballast light shield 44 the outer surface of which is preferably coated with a diffusely reflective white paint.

As best shown in FIGS. 3 and 5, a display panel 45 of translucent, preferably white, flexible plastic film or fabric is stretched in planar form across the front of the rectangular frame 15 of FIG. 1. The front flanges of the horizontal and vertical frame members have bonded thereto a strip of hook type connector fabric 46. The margins of the display panel 45, which is rectangular in shape, corresponding to the shape of the front face of the frame 15, has bonded thereto a strip of loop type connector fabric 47. When the loop type connector strip 47 is pressed against the hook type connector strip 46, a releasable firm connection of the margins of the display panel 45 to the front flanges of the frame members is provided.

FIG. 3 illustrates a clamping strip 48 of generally L-shaped cross section having a portion thereof overlaying the adjacent margin of the display panel 45. Clamping strip 48 is provided with screws, such as the screw 49 extending through an aperture therein and threaded into an aperture 50 in the front flange of the frame bottom channel 21. Tightening of the screw 49 and the others (not shown) on strip 48 compressively clamps the hook and loop connector strips 46 and 47 and the adjacent marginal portion of the display panel 45 into tight engagement, preventing inadvertent separation of the interconnected hook and loop connector strips.

FIG. 5 illustrates a clamping strip 51 provided with a screw 52 extending through an aperture therein and threaded into an aperture 53 in the front flange of the left hand vertical frame channel 18. The clamping strip 48 is preferably substantially coextensive with the horizontal dimension of the display panel 45, and the clamping strip 51 is preferably substantially coextensive with the vertical dimension of said display panel. Corresponding clamping strips (not shown) are mounted on the front flange of the upper horizontal frame channel 20 and the front flange of the right hand vertical frame channel member 19, so that the display panel and the hook and loop connector strips are clamped substantially all around the frame 17.

The display panel 45 is adapted to bear a preferably flexible image to be illuminated. The image can be produced as a translucent photograph on a film base, or it can take the form of a screen printed or computer spray painted image on white fabric or translucent white plastic film forming the display panel 45. A number of such products is commercially available, for example those sold under the trademarks ROSCOMURAL®, DURATRANS®, ILFOCHROME®, and 3M SCOTCHPRINT®. For displays incorporating the present invention, such images are uniformly illuminated at an intensity of about 300 foot lamberts.

An important feature of the present invention is best shown in FIGS. 2, 3 and 5. FIG. 5 shows a light spreader 56 carried by the back wall 24 adjacent the lamp 38, and a light spreader 55 which is similarly carried by the back wall 24 adjacent the lamp 39. It is understood that lighting units of the array shown in FIGS. 1 and 2 are substantially identical, so that the description of the lighting unit 16 shown in FIGS. 3 and 5 is applicable to each of the lighting units of a given array.

The light spreaders 54 and 55 are preferably identical, each having a pair of elongated planar rectangular members having reflective outer surfaces. The light spreader 54 has planar rectangular members 56 and 57 which extend at an angle to one another and have their front marginal portions joined at a vertex 58. The members 56 and 57 extend substantially the full length of the light emitting portion of the associated lamp 38. As best shown in FIG. 5, the angle between the members 56 and 57 is substantially bisected by a plane 59 which extends through the vertex 58, includes the axis of the lamp 38 and is normal to the display panel 45. The light spreader 55 associated with the lamp 39 has members 60 and 61 which are joined at a vertex 62. A plane 63 bisects the angle at the vertex 62, includes the axis of lamp 39 and is normal to the display panel 45.

The light spreaders 54 and 55 can take the form of an extrusion having the cross sectional shape thereof shown in FIG. 5, and such extrusion can, for example, take the form of metal or plastic. Alternatively, the light spreaders 54 and 55 can be formed directly into the aluminum back wall 24, rather than being fixed to said back wall by bonding or rivets (not shown). Regardless of the form which the spreaders 54 and 55 may take, it is important that the back wall 24 have a diffusely reflective white surface, and that said light spreaders be capable of reflecting light from the respective associated lamps toward locations on said back wall laterally outwardly from said light spreaders and from which said light is reflected toward portions of the display panel in front of said lamps. In the presently preferred form of the invention, the light spreaders, as well as all the other surfaces of the lighting unit 16 exposed to the light from lamps 38 and 39 also have diffusely reflective white surfaces, for example, as provided by commercially available diffusely reflective white paint.

Another important feature of the present invention is a variable opacity light leveling mask, which extends the full length of the light emitting portion of each lamp. In FIG. 5, masks 64 and 65 are shown respectively associated with T12 type lamps 38 and 39. All of the lamps of a given array are preferably of the same diameter, and masks 64 and 65 are preferably identical. As shown in horizontal section in FIG. 5, said masks are semicylindrical in shape. They are adhered to the outer surface of the associated lamp with the longitudinal axis of said mask coincident with the plane 59 or 63 as the case may be. The masks have a width to extend around the circumference of the associated lamp from one end of the diameter normal to the plane 59 or 63, around the front side of said lamp to the other end of said diameter. In their presently preferred form, the masks of the invention each comprise an array of white, diffusely reflective preferably opaque elements spaced along a longitudinal axis in the planes 59 or 63 and extending laterally outwardly from said axis.

Figure 7:
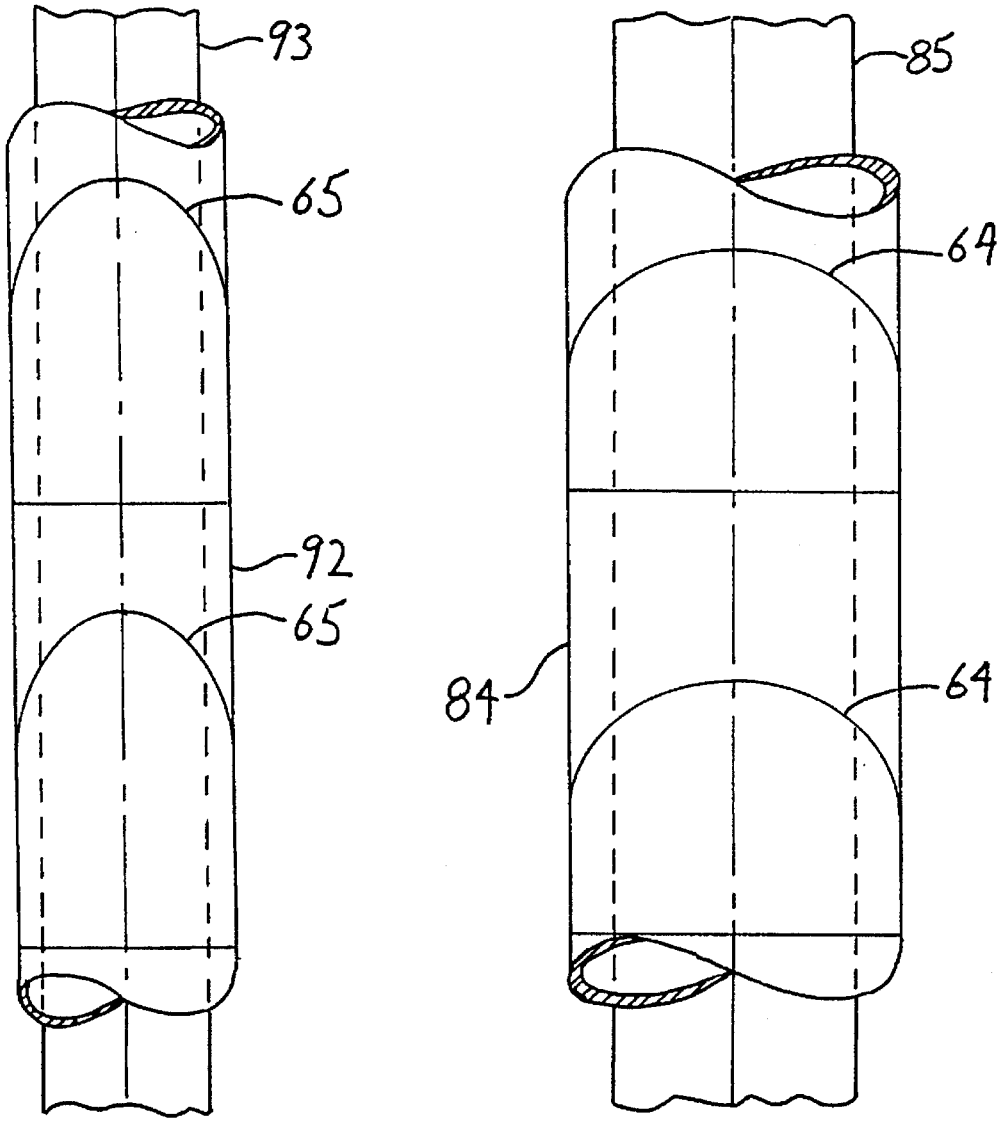
FIG. 7 shows fragmentary front elevational views of T8 and T12 type lamps to which opaque semicylindrical masks of the invention are adhesively laminated, and it also shows the light spreader associated with each lamp.

FIG. 7 shows a portion of a T8 size lamp 82, and a portion of a T12 size lamp 83 as viewed, for example, along the line VII—VII of FIG. 5. The T8 type lamp 82 is fitted with a mask comprising spaced elements 65, and the T12 lamp 83 is fitted with a mask comprising spaced elements 64. Shown behind the lamps 82 and 83 are light spreaders 93 and 85, respectively associated therewith.

Figure 6:
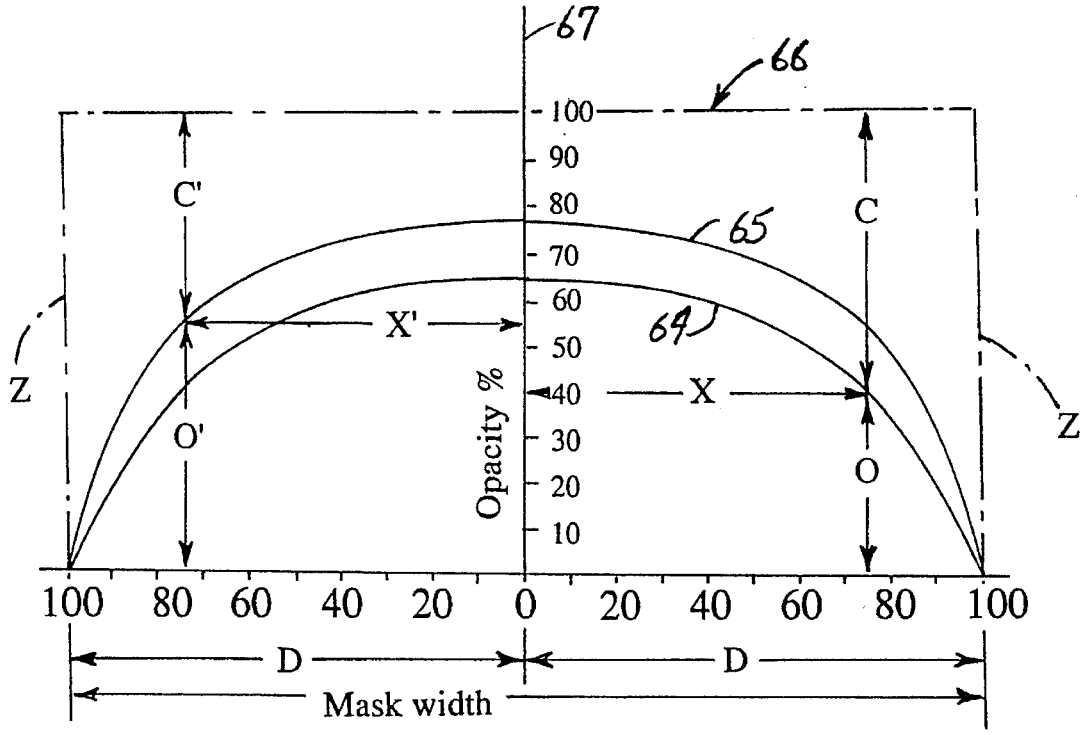
FIG. 6 shows curves which illustrate the percentage of light from an associated lamp which is blocked at all points across the effective width of semicylindrical masks of the present invention useful on T12 and T8 size fluorescent lamps.

Referring to FIG. 6, a mask element 66 adapted for use on a T12 (1.5 inch diameter) lamp, as well as an element 67 adapted for use on a T8 (1.0 inch diameter) lamp are shown therein. In FIG. 6, the horizontal coordinates are the percentage of the element half length D, whereas the vertical coordinates are percent opacity of the mask. The mask elements in FIG. 6 are located within a rectangle 66 having a length 2D and a width Z as shown, and said elements are positioned symmetrically along the longitudinal axis 67 thereof a distance produced by having the rectangle 66 of each mask in abutment with the rectangle for the mask (not shown) above it and the rectangle for the mask (not shown) therebelow.

The elements 66 and 67 are preferably formed from opaque diffusely light reflective film such as computer cut metal or opaque vinyl film which is adhered to the respective lamp with an appropriate adhesive. An example of one metallic film which is suitable for use for this purpose is SCOTCHCAL® No. 5430 brushed aluminum film available from 3M Company, St. Paul, Minn. 55133. This film is provided with an adhesive backing facilitating attachment thereof to the surface on which it is to be mounted.

In FIG. 6 the curves 64 and 65 show the percentage of light from an associated lamp which must be blocked by the variable opacity mask throughout the light emitting portion of the associated lamp for the optimum light leveling effect to be produced thereby. In FIG. 6 the area below a curve, indicated by the letters O and O', is the percent Opacity at the given point thereon. The area above a curve within the respective rectangle indicated by the letters C and C' is clear or nonobstructive to light flux flow and is the complement to the opacity at any given point on a curve.

As indicated by the curve 64, maximum opacity, and therefore light blocking, occurs at the axis 67. This opacity is about 64 percent, and the operative range for such opacity is from about 62 percent to about 66 percent of the light flux from the lamp directed at the axis 67. By virtue of the tapered configuration of the mask element 64, such light blocking is symmetrically attenuated at increasing distances X on each side of axis 67, as indicated by the shape of curve 64, reaching zero at the margins of the mask defined by the vertical lines Z forming part of the rectangle 66.

In FIG. 6, the distance X shown on curve 64 is 75 percent of the distance from the axis 67 to the adjacent margin of the mask, and the percentage of light blocked at that point, indicated by the letter O, is preferably about 41 percent, with an operative range of from about 39 percent to about 43 percent. This opacity is from about 59 to about 69 percent of the opacity at the longitudinal axis.

In FIG. 6, the curve 65 exhibits the preferred opacity at the axis 67 for an element to be used on a T8 (1.0 inch diameter) lamp which is about 76 percent, the operative range for such opacity being from about 74 percent to about 78 percent. The distance X' shown is 75 percent of the distance from the axis 67 to the left hand margin of the mask, and the percentage of light blocked at that point, indicated by the letter O' is about 60 percent, with an operative range of from about 55 percent to about 62 percent, said opacity being from about 72 percent to about 84 percent of the opacity at the axis 67.

While the presently preferred form of mask is represented by the spaced mask elements 64 and 65, the mask may comprise any shape element or elements which produce a light transmission coefficient which varies with the distance X or X' (in FIG. 6) at which the light flux from the lamp intersects the element. As the curves in FIG. 6 indicate, the light transmission coefficients of said curves adjust the ratios of the clear, i.e., C or C' areas of rectangular zone 66 and the opaque areas O or O' of said zone to increase the net width of the clear area and decrease the net width of the opaque area as the distance X increases.

Alternative forms/of the mask include, for example, those which are split normal to the mask axis 67 into a multiplicity of parallel sections which are spaced apart in the direction of the axis; as well as a mask having longitudinal elements parallel with the axis 67 and spaced apart transversely thereof.

In FIG. 6, the horizontal coordinates are in terms of element half length percent. Thus, the semicylindrical masking elements 64 and 65 have a dimension 2D between the opposite margins thereof, which dimension is preferably one-half of the circumference of the respective lamp.

As is evident in FIG. 6, the mask element 65 for use on the 1 inch diameter T8 lamp has a significantly greater opacity at most points thereon than the corresponding element 64 which is useful on the T12 (1.5 inch diameter) lamp. The opacities at the 0.75D positions are also greater for the element useful on the T8 lamp than that for the element useful on the T12 lamp. One reason for this is believed to be that the light directed rearwardly from the T8 lamp toward the backwall 24, upon reflection forwardly therefrom toward the display panel 45, is blocked by the silhouette of the T8 lamp to a lesser degree than it is blocked by the wider silhouette of the T12 lamp. The greater element opacity, i.e., longitudinal dimension, at the axis 67 and at the corresponding 0.75D positions, is therefore required of semicylindrical masks used on the T8 lamps in order to avoid undesirable levels of brightness on the display panel 45.

FIG. 7 shows sections of a T8 lamp 82 and a T12 lamp 83, respectively provided with masking elements 65 and 64 and illustrates that the mask elements 65 have a greater longitudinal dimension, i.e., parallel with the lamp axis, than do the element 64 on the T12 lamp.

Application of the mask elements such as elements 64 and 65 to the respective lamps can be facilitated by applying an aggressive adhesive to one side of said elements and applying a less aggressive adhesive to the opposite side thereof. The mask can be prefabricated by applying the less aggressive side thereof to a suitable supporting web or band. The supporting web, with the mask carried thereby, is then applied to the full length of the light emitting portion of the outer surface of the respective lamp, so that the mask is adhered firmly thereto by means of the aggressive adhesive. Once the mask is thus adhered in operative position on the respective lamp, the supporting web can be peeled therefrom without disturbing the mask. By this procedure the mask can be applied to a lamp in one operation, without the need to handle and apply individual elements during such application.

The variable opacity masks of the invention thus far described provide illuminance of the display panel of a light box, and of the image thereon, which exhibits brightness variations of no more than about 2.5 percent.

However, under certain conditions, for example, when a display embodies many lamps and the image illuminated has a certain tonal density, and the percentage of constant tonal density within a given range is at a certain level, a slight residual shadow appears on said image directly in front of the lamp when the masking thus far described is used, even though the brightness nonuniformity produced by such masking does not exceed the very low levels of about 2.5 percent for T12 lamps and 2.3 percent for T8 lamps.

By the present invention I have been able to reduce this residual shadow by a factor of 3 to less than 1 percent of brightness nonuniformity. Thus, with the invention incorporated into a large multi lamp fluorescent backlit display, the brightness of the display panel is so uniform that the eye can no longer detect any lamp pattern or shadow in the intermediate tonal areas of any photographic scene or similar image. By the use of the invention, brightness uniformity throughout the image area is now specifiable at a surprisingly low plus or minus ½ percent. While individual lamps can vary a few percent in brightness due to manufacturing tolerances, such variances are not discernable to the eye because it is a long range variance with maximum and minimum levels spaced apart the distance of lamp separation, i.e. about 10 inches.

The improvement in brightness uniformity is brought about by the use in each lighting unit of a light spreader in association with each lamp in said unit. For example, as shown in FIG. 5, there is a light spreader 54 associated with the lamp 38, and a light spreader 55 associated with the lamp 39. FIG. 3 illustrates the relationship of the light spreader 54 with the lamp 38 on an enlarged scale. As shown in FIG. 5 the light spreaders are positioned so that the angle formed at the juncture of the forward margins of the elongated rectangular planar members thereof, which join at the vertices 58 and 62 is bisected by the plane 59 or 63 which includes the axis of the respective lamp and is normal to the display panel 45. The rear margins of the members 56 and 57 and 60 and 61 are substantially at the plane of the back wall 24 of the respective lighting unit 16.

Figure 11:
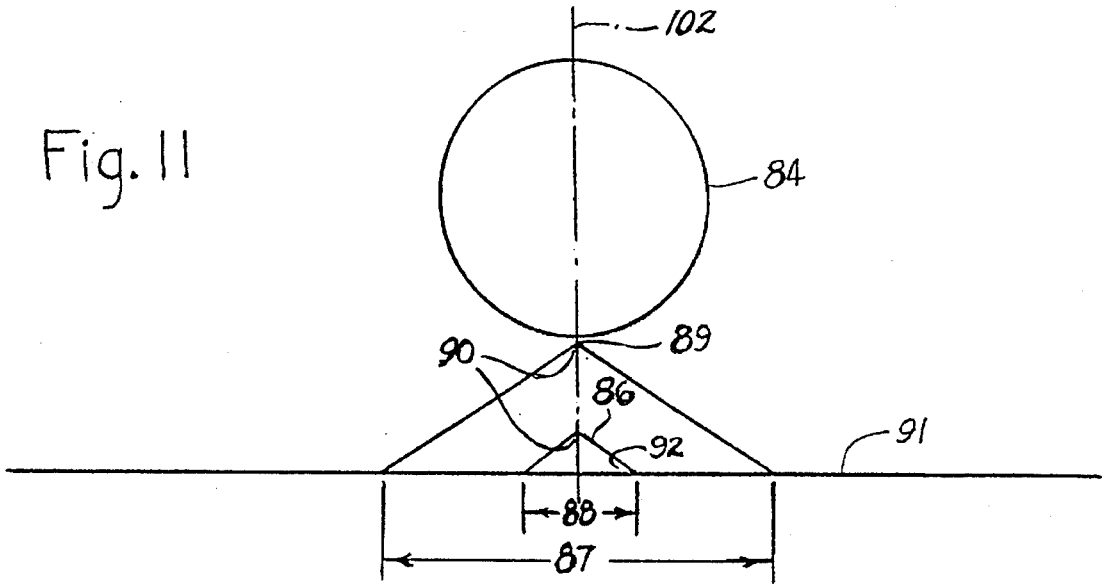
FIG. 11 is a diagram illustrating the range of shapes and sizes of light spreaders useful when a T12 lamp is used in the present invention.
Figure 12:
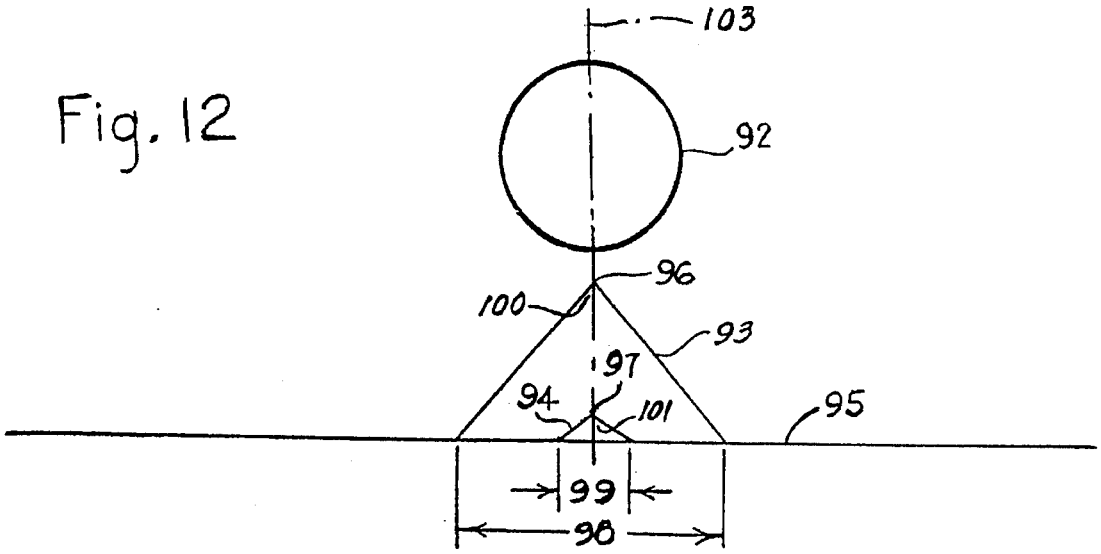
FIG. 12 is a diagram illustrating the shapes and sizes of light spreaders useful when a T8 lamp is used in the present invention.

FIGS. 11 and 12 illustrate diagrammatically the range of sizes and shapes of light spreaders useful in the present invention. In FIG. 11, a T12 type lamp 84 is shown in transverse section and two light spreaders 85 and 86, illustrate the range of useful light spreaders for the T12 type lamp. In FIG. 11 the space between the rear margins of the spreader 85, indicated by the numeral 87, is about 2.25 inches. The corresponding space between the rear margins of the spreader 86, indicated by the numeral 88 is about 0.75 inch. The angle formed at the vertex, indicated by the numeral 90 can vary from about 80 degrees to about 120 degrees, and the acute angles at which the rear margins of the spreaders join the back wall 91, indicated by the numeral 92, are preferably within the range of from about 30 degrees to about 50 degrees. In FIG. 11 the vertex 89 for the light spreader 85 is spaced from the back wall 91 about 0.70 inch and the axis of the lamp 84 is spaced from said back wall about 1.5 inches. The vertex of the light spreader 86, on the other hand, is spaced from the back wall 91 approximately 0.25 inch.

FIG. 12 is similar to FIG. 11 but shows diagrammatically the relationship of a T8 type lamp in relation to a pair of light spreaders 93 and 94 and a back wall 95. The axis of the lamp 92 is spaced from the back wall 95 about 1.5 inches, the vertex 96 of light spreader 93 is spaced from the back wall about 0.85 inches, and the vertex of the light spreader 94 is spaced from the back wall 95 a distance of about 0.15 inch. The rear margins of the light spreader 93 at the back wall 95 are spaced apart a distance 98 of about 1.5 inches, and the rear margins of the light spreader 94 at the back wall 95 are spaced apart a distance 99 of about 0.5 inch.

The values given for the diagrams in FIGS. 11 and 12 are illustrative of the preferred relationships of the light spreader with the lamp and back wall which can be stated as follows: the rear marginal portions of the elongated rectangular reflective surfaces of the light spreader are preferably spaced apart a distance of from about 0.5 to about 1.5 times the diameter of the cylindrical lamp; the vertex of the light spreader is spaced from the plane of the back wall a distance which is from about 30 percent to about 55 percent of the distance between the rear marginal portions of the elongated rectangular reflective surfaces of the light spreader at the back wall, but not greater than the distance between the lamp and the back wall. In FIG. 11 the phantom line 102 indicates a plane which includes the axis of lamp 84, the vertices of the light spreaders 85 and 86, and which is normal to the back wall 91. Similarly, in FIG. 12 the phantom line 103 indicates a plane which includes the axis of the lamp 92 and vertices of light spreaders 93 and 94, said plane being normal to the back wall 95. The planes 102 and 103 bisect the angles of the vertices of the light spreaders through which they pass.

The light spreaders of the present invention as exemplified in FIGS. 3 and 5, for example, while simple in construction provides an unexpectedly good solution to the residual shadow problem discussed in connection with FIG. 8. More particularly, the elongated planar preferably diffusely reflective outer surface of the side walls of the light spreaders reflect light flux from the rear of the associated lamp directed thereat laterally outwardly. In so doing it causes the effective diameter of the virtual lamp image shown in FIG. 8 to grow in size and reduce somewhat in brightness. The light flux thus spread, is reflected from the diffusely reflective back wall toward the display panel in the spaces between adjacent lamps. The net result is that the residual shadow aforedescribed is reduced to such an extent that it approaches the limit of error in precision spot photometric measurement, and the brightness of the image on the display panel becomes so uniform that the eye no longer detects any lamp pattern or shadow in the intermediate tonal areas of any photographic scene.

Figure 10:
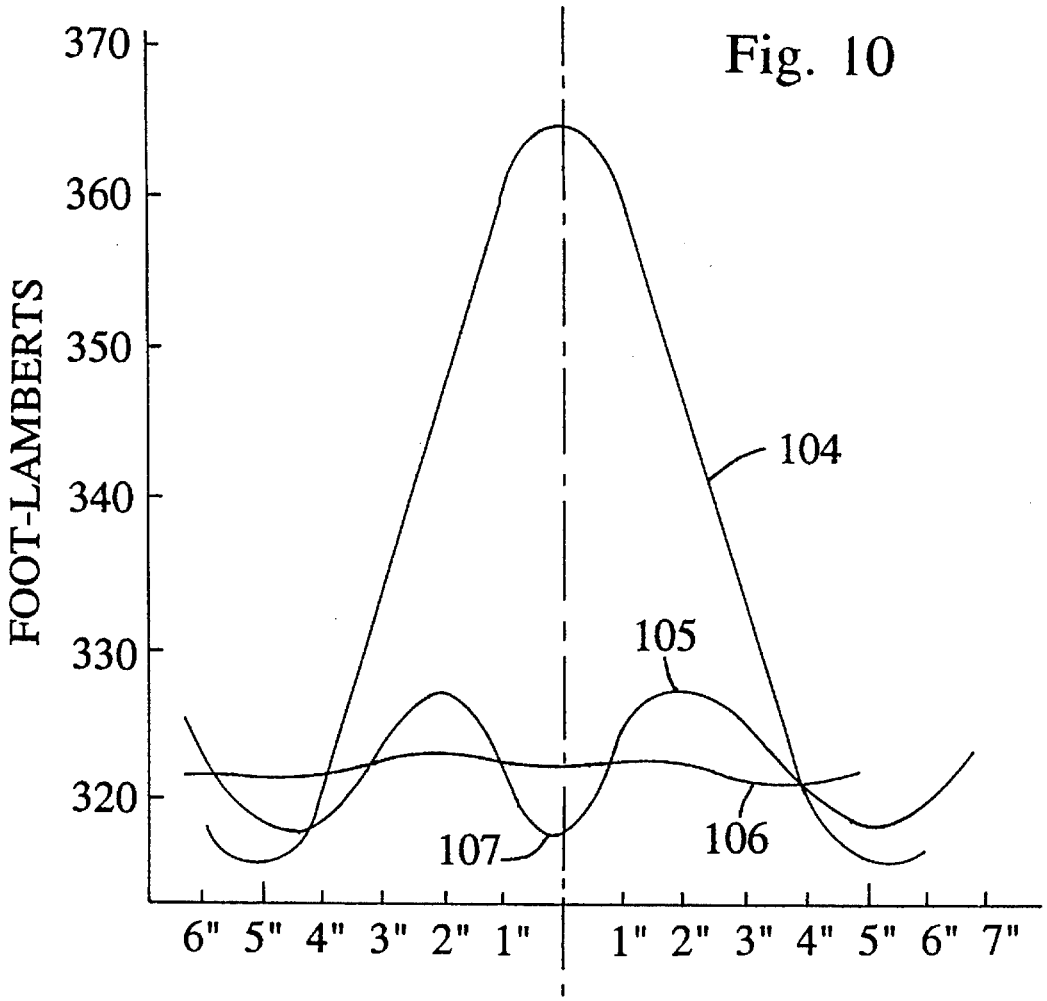
FIG. 10 shows curves representing photometric scans of a display panel in front of one lamp of several in parallel, said curves illustrating the illumination provided by conventional backlit displays; the illumination provided when a semicylindrical mask of the invention is used on the lamp; and the illumination provided when a semicylindrical mask of the invention is used on the lamp and a light spreader of the invention is associated with said lamp.

FIG. 10 presents curves illustrating the degree to which the invention modulates the intensity of the light from one lamp of several in parallel in the illumination of an image on the image panel 45. In FIG. 10 the curve 104 illustrates a photometric scan across the image panel in front of one lamp of several in parallel. Illumination of this type provides brightness variations which are clearly visible to the human eye, in almost any type backlit display. Curve 105 in FIG. 10 illustrates that the brightness variation can be reduced five fold by the use of the semicylindrical mask described earlier herein. Curve 106 in FIG. 10 illustrates that when the light spreaders of the present invention are used in conjunction with the cylindrical masks, the brightness variation at the image is further reduced by a factor of about three. The light spreaders, by reflecting the light flux directed thereagainst from the back of the lamp laterally outwardly toward locations on the planar back wall away from the light blocking effect of the respective lamps, thereby provide additional brightness to said back wall at such locations. This provides increased light flux forwardly from the back wall between the lamps, and toward portions of the display panel in front of said lamps which light flux is effective to fill in the residual shadow which may have been present, for example, at the point 107 on curve 105 of FIG. 10 in the absence of a light spreader.

A very significant but unexpected result which was found with respect to the present invention is that the extent of suppression of the residual shadow is relatively insensitive to the size or angularity of the light spreaders. The variations in size and configuration of the light spreader within the ranges shown in FIGS. 11 and 12 are all effective to limit brightness variations to 1.0 percent or less for both T12 and T8 type lamps.

The aforementioned insensitivity has the practical aspect of easing manufacturing tolerances. In fact, testing shows that the light spreader location can be varied plus or minus ⅛ inch laterally from the plane through the axis of the lamp and normal to the display panel without noticeably diminishing the light leveling effect produced by the invention. Experimentation has further shown that the brightness variation of plus or minus 0.6 percent can be achieved by the use of the cylindrical masks and light spreaders of the invention.

The construction of the display of the present invention is such that it can be assembled and disassembled readily and without the need to handle heavy components. The frame members 18, 19, 20 and 21 can be connected together by any suitable releasable means (not shown), with the top frame member 20 being readily removable. Depending upon the size of the display, it can be assembled with the frame in the vertical position shown in FIG. 1, or by tilting the frame to a horizontal position on a suitable support.

With the top frame member 20 removed, the modular lighting units 16 to **16*c*, and any additional units to be accommodated within the frame 17, can be inserted end wise into the side by side relationship within the frame shown in FIG. 1. Entry of dust laden air into the enclosure provided by the display of the invention, can be prevented by placing thin layers of polyurethane foam or the like (not shown) below, above and between adjacent units and between the end units and the adjacent vertical frame members. The lighting units can have the lamps 38 and 39** mounted therein during such assembly. However, if desired the lamps can be inserted into the lighting units after said units are placed in operative position within the frame.

Suitable electric wiring (not shown) is provided to interconnect adjacent modular lighting units and to connect the display to a source of electrical power. With the lighting units in the positions shown in FIG. 1, the horizontal top frame member 20 is then fixed in the position shown therein.

The flexible display panel 45 is then positioned with the loop type connector strip 47 on the margin thereof in registration with the hook type connector strips 46 bonded to the front face of the frame 17. The loop type strip 47 on the display panel is then pressed against the hook type connector strip so that the two are interengaged.

An elongated clamping strip 48 shown in section in FIG. 3, which extends the whole length of the horizontal lower frame member 21, is positioned over the adjacent marginal lower edge portion of the display panel 45 as shown in FIG. 3, and is placed in clamping engagement with said display panel margin by means of screws, such as a screw 49 as seen in FIG. 3. FIG. 5 shows a similar clamping strip 51 on the left hand vertical 18 which overlies the adjacent marginal portion of the display panel and is held in clamping engagement therewith by the screw 52 which is threaded into a suitable aperture in the front flange of the frame member 18 as shown. Similar clamping strips (not shown) are applied to the marginal portions of the display panel 45 overlying the front face of the right hand frame member 19 and the front face of the upper horizontal frame member 20.

To disassemble the assembled backlit display, the reverse sequence of steps is followed. The clamping strips 48 and 51 are removed along with the corresponding pair of strips (not shown), after which the display panel 45 is removed from the frame 15 by grasping one corner and peeling the loop type connector strip thereon away from the hook type connector strip bonded to the frame. The top frame member 20 is then removed, the modular lighting units 16 to **16*c* are then slid vertically from the frame 17**, and the frame is then disassembled. To facilitate handling of the frame members, they can, if desired, be formed in separable sections which may be connected by any suitable releaseable connector means (not shown).

While the display illustrated in the drawings is of a free standing character, it is understood that the invention contemplates mounting of the frame 17 on a supporting wall. When this is done, it is preferably mounted in spaced relation with the supporting wall to provide channels behind the display for the flow of cooling air. The trays 24 of the lighting units are formed of thermally conductive metal, such as aluminum, through which heat from the inside of the display is conducted to the cooling air flowing by convection between the display and supporting wall.

The trays 24 of the lighting units can be formed in one piece, as well as the in sectional form shown herein. The connection for the tray sections **24*a* and 24*b* can take any suitable form. However, the illustrated embodiment is presently preferred. As best shown in FIGS. 1, 13 and 15, the sections 24*a* and 24*b* of tray 24 are pivotally interconnected by hinges 108 and 109 which respectively connect the tray walls 27*a* and 27*b* and 28*a* and 28*b***.

Referring to FIGS. 13 and 14 the hinge 108 is formed of two complementary hinge members 110 and 111 and a cooperable pivot pin 112. Hinge members 110 and 111 respectively have elongated rectangular bar portions 113 and 114 and laterally offset circular end portions 115 and 116. The bar portions 113 and 114 are respectively fixed, as by rivets 117 and 118, to the marginal inner end portions of the tray sidewalls **27*a* and 27*b*** as shown.

The hinges 108 and 109 are of similar construction and permit pivotal rotation about the axis of pivot pin 112 of, for example, tray section **24*b* with respect to tray section 24*a*. Thus, upon removal of the lamps from a lighting unit, the tray section 24*b* can be rotated with respect to section 24*a* from the solid line position thereof to the phantom line position thereof in FIG. 13**. Folding substantially reduces the length of a tray and greatly facilitates handling and shipping of the modular components.

Various change and modifications of the invention described herein will become apparent to those skilled in the art, and all of such changes are contemplated as may come within the scope of the appended claims.

I claim:

1. A fluorescent backlit display comprising, in combination, a planar light transmissive display panel; a generally planar back wall having a surface facing, spaced from and parallel with said display panel , said surface being white, substantially nonspecular and diffusely reflective; at least one elongated cylindrical lamp spaced from, parallel with and between said back wall and display panel; and an elongated light spreader aligned with the light emitting portion of said at least one lamp and disposed between said lamp and the plane of said back wall surface for impingement thereon of light flux projected from the back of said lamp, said light spreader having reflective surface portions positioned to reflect such impinging light flux laterally outwardly toward locations on said substantially nonspecular and diffusely reflective back wall surface from which locations portions of said light flux are reflected forwardly along paths disposed laterally outwardly from said lamp toward portions of said display panel directly in front of said lamp.

2. The combination of claim 1 wherein said light spreader reflective surface portions are a pair of elongated planar surfaces having front longitudinal marginal portions which are joined at a vertex to form a generally V-shape in transverse section, said vertex being spaced from and adjacent said lamp , and said light spreader reflective surface portions have rear longitudinal marginal portions adjacent said back wall surface, said vertex lying generally in a plane which includes the axis of said lamp, substantially bisects the angle formed between said reflective surface portions of said light spreader and is generally normal to said back wall and display panel.

3. The combination of claim 2 wherein said angle is from about 80 degrees to about 120 degrees.

4. The combination of claim 2 wherein the rear longitudinal marginal portions of said elongated surfaces are spaced apart a distance of from about 0.5 to about 1.5 times the diameter of said cylindrical lamp.

5. The combination of claim 2 wherein said vertex is spaced from the plane of said back wall surface a distance which is from about 30 percent to about 55 percent of the lateral distance between the rear marginal portions of the elongated reflective surfaces, and less than than the distance between said lamp and said back wall.

6. The combination of claim 2 wherein the longitudinal rear marginal portions of said elongated surfaces are spaced apart a distance of from about 0.5 to about 1.5 times the diameter of said cylindrical lamp; and said vertex is spaced from the plane of said back wall a distance which is from about 30 percent to about 55 percent of the distance between said rear marginal portions, and less than the distance between said lamp and said back wall.

7. The combination of claim 1 wherein said lamp has a diameter of about 1.0 inch and the axis of said lamp is spaced from said back wall surface a distance of about 1.5 inches.

8. The combination of claim 1 wherein a variable opacity mask overlies the surface of said at least one cylindrical lamp facing said display panel and has a longitudinal axis located in a plane which is normal to said display panel and said back wall surface, which plane also includes the axis of said lamp, said mask being substantially coextensive with the length of the light emitting portion of said lamp, said combination being capable of providing illumination of said display panel with a maximum brightness nonuniformity of the order of about 1 percent.

9. The combination of claim 8 wherein said variable opacity mask has opposite margins substantially equally spaced laterally from and generally parallel with said longitudinal axis and having an opacity along its longitudinal axis effective to block from about 74 percent to about 78 percent of the light flux from said lamp directed thereat, the opacity of said mask being symmetrically reduced at increasing lateral distances from said longitudinal axis, reaching substantially zero at said mask margins, and at points thereon spaced about 75 percent of the lateral distance from said longitudinal axis toward each of said mask margins, said mask has an opacity which is from about 72 percent to about 84 percent of the opacity thereof at said longitudinal axis.

10. The combination of claim 9 wherein there is a plurality of said lamps in equally spaced parallel relation, and each of said lamps has one of said variable opacity masks and one of said light spreaders associated therewith.

11. The combination of claim 8 wherein there is a plurality of said lamps in equally spaced parallel relation, and each of said lamps has one of said variable opacity masks and one of said light spreaders associated therewith.

12. The combination of claim 1 wherein said diffusely reflective back wall is the back wall of one of a plurality of like modular rectangular lighting units which each comprise at least one of said cylindrical lamps, said units being mounted on a rectangular supporting frame which also supports said display panel.

13. The combination of claim 12 wherein there are two of said lamps mounted on each of said modular lighting units in predetermined spaced parallel relation, each of said lamps having one of said light spreaders associated therewith on the back wall of the respective unit.

14. The combination of claim 13 wherein said plurality of modular rectangular lighting units is supported on said rectangular frame in abutting side by side relation in which all of said lamps are in equally spaced parallel relation.

15. The combination of claim 13 wherein each said modular rectangular lighting unit comprises an elongated tray which is formed in sections and serves as said back wall.

16. The combination of claim 1 wherein the reflective surface portions of said light spreader are diffusely reflective.

17. A fluorescent backlit display or the like comprising, in combination, a rectangular supporting frame; a planar light transmissive display panel mounted on the front of said frame; at least two elongated modular rectangular lighting units removably mounted on said supporting frame in side by side abutting relation, each said lighting unit having a generally planar diffusely reflective back wall spaced from and generally parallel with said display panel and at least one elongated cylindrical lamp in spaced relation between and parallel with said backwall and display panel.

18. The combination of claim 17 wherein there are more than two of said modular lighting units mounted in said frame in side by side abutting relation, with all of said lamps in equally spaced parallel relation.

19. The combination of claim 17 wherein each said modular lighting unit comprises at least a pair of said lamps in spaced parallel relation with each other, said back wall and said display panel.

20. The combination of claim 18 wherein each of said modular lighting units comprises an elongated rectangular tray on which a plurality of said lamps is mounted with their axes spaced apart a predetermined uniform distance, said tray having opposite longitudinal side walls, the axes of said lamps nearest the respective side walls being parallel with and spaced from said adjacent side walls, respectively, a distance equal to about one half the uniform distance between said lamp axes, whereby when said modular lighting units are in side-by-side abuttment, all of the lamps of said lighting units are in equally spaced parallel relation.

21. The combination of claim 17 wherein said frame, abutting modular lighting units and image panel form an enclosure substantially impervious to entry by dust laden air.

22. The combination of claim 17 wherein each of said modular lighting units comprises an elongated rectangular tray which is formed in sections and serves as said back wall.

23. A fluorescent backlit display or the like comprising, in combination, a rectangular supporting frame; a planar light transmissive display panel mounted on the front of said frame; at least two elongated modular rectangular lighting units mounted on said supporting frame in side by side abutting relation, each said lighting unit having a generally planar diffusely reflective back wall spaced from and generally parallel with said display panel, and at least one elongated cylindrical lamp in spaced relation between and parallel with said back wall and display panel, each of said modular lighting units comprising an elongated rectangular tray which is formed in sections and serves as said back wall, said tray sections being hingedly connected for pivotal movement about an axis normal to the longitudinal dimension of said tray.

* * * * *